US007506491B2

(12) United States Patent
Rimondi

(10) Patent No.: US 7,506,491 B2
(45) Date of Patent: Mar. 24, 2009

(54) METHOD AND MACHINE FOR PACKAGING FOOD PRODUCTS IN TRAYS SEALINGLY CLOSED AT THE TOP WITH A THERMOPLASTIC FILM

(75) Inventor: Renato Rimondi, Bazzano (IT)

(73) Assignee: A.W.A.X. Progettazione E Ricerca S.r.l. (IT)

( * ) Notice: Subject to any disclaimer, the term of this patent is extended or adjusted under 35 U.S.C. 154(b) by 0 days.

(21) Appl. No.: 11/814,884

(22) PCT Filed: Jan. 31, 2006

(86) PCT No.: PCT/EP2006/050562

§ 371 (c)(1),
(2), (4) Date: Jul. 26, 2007

(87) PCT Pub. No.: WO2006/084807

PCT Pub. Date: Aug. 17, 2006

(65) Prior Publication Data

US 2008/0120944 A1 May 29, 2008

(30) Foreign Application Priority Data

Feb. 10, 2005 (IT) ..... BO2005A0065

(51) Int. Cl.
*B65B 55/00* (2006.01)
*B65B 31/04* (2006.01)
*B65B 41/16* (2006.01)

(52) U.S. Cl. ..... 53/510; 53/432; 53/89; 53/389.2

(58) Field of Classification Search ..... 53/432, 53/477, 485, 89, 94, 101, 510, 300, 389.2
See application file for complete search history.

(56) References Cited

U.S. PATENT DOCUMENTS 3,069,273 A * 12/1962 Wayne ..... 53/412

(Continued)

FOREIGN PATENT DOCUMENTS

EP 0 252 792 1/1988

*Primary Examiner*—Paul R Durand

(57) ABSTRACT

The machine comprises: a reel (3) with means (4, 104) for controlled unwinding therefrom of film (30) for closing the trays; first means (5) which are situated underneath the said reel and around which the film is deflected so as to pass from a descending path to a horizontal path; counter-die means (12) for supporting at least one tray (V) horizontally, along the upper edge (Z), with a predefined orientation and for displacing it horizontally underneath the said horizontal section of film, with entry via the said first means (5) for deviating the said film and with feeding in synchronism with the film which gradually closes the tray at the top; means (5) situated downstream of the first film deviating means (31), for sealingly welding the film onto the upper edge of the tray; means (27) situated upstream of the said first deviating means (5) for blowing an appropriate amount of the modified atmosphere at appropriate pressure values into the open part of the tray which advances underneath the film until the tray itself has been completely sealingly closed by the film; means (48) for separating from the film the portion thereof welded to the upper edge of each tray containing the product under a modified atmosphere; means (7, 107) for taking up the waste film produced by the said separation means (48), which operate in conjunction with the said means for unwinding the film from the said reel, so as to ensure that at least the section of film along the said horizontal path advances always stretched both longitudinally and transversely; means (29, 427, 8) which, at the start of the cycle, feed and position correctly in the counter-die means (12) the trays (V) to be closed and means (15) which, at the end of the said cycle, raise from the said counter-die means and prepare for unloading, the closed trays (V1) having inside the product under a modified atmosphere; means (58) for conveying away the closed trays (V1); means (10) for horizontally moving the said counter-die means, which at the end of the cycle bring these means (12) back into the starting position, for repetition of a new working cycle.

33 Claims, 6 Drawing Sheets

U.S. PATENT DOCUMENTS 3,874,145 A * 4/1975 Schmidt ..... 53/510
3,908,342 A * 9/1975 Raque ..... 53/329.4
4,058,953 A * 11/1977 Sanborn et al. ..... 53/433
4,162,599 A * 7/1979 Kyle ..... 53/77
4,624,099 A * 11/1986 Harder ..... 53/432
4,685,274 A * 8/1987 Garwood ..... 53/433
4,870,800 A * 10/1989 Kasai ..... 53/88
5,271,207 A * 12/1993 Epstein et al. ..... 53/432
5,419,097 A * 5/1995 Gorlich et al. ..... 53/432
6,042,862 A * 3/2000 Kocher et al. ..... 426/411
6,202,388 B1 3/2001 Sanfilippo et al.
6,698,165 B1 * 3/2004 Natterer ..... 53/509
7,313,900 B2 * 1/2008 Granili ..... 53/427
2001/0017021 A1 8/2001 Sanfilippo et al.

* cited by examiner

METHOD AND MACHINE FOR PACKAGING FOOD PRODUCTS IN TRAYS SEALINGLY CLOSED AT THE TOP WITH A THERMOPLASTIC FILM

DESCRIPTION

A current technique for packaging many food products envisages placing the product inside a tray which is usually made of thermoplastic material impermeable to gases or certain gases and has a height the same as or greater than that of the product and then envisages closing the said tray with a film which is also thermoplastic and impermeable to gases or certain gases. The film is sealingly welded along the edge of the tray with a heat-sealing operation and usually by means of a special heated die having a form in plan view which is correlated to that of the trays used. This technique, which is currently referred to as a top seal or tray seal technique, is currently used to process the vast majority of food products which are packaged industrially and intended for distribution via the leading supermarket chains. This technique is very suitable for packaging food which contains a large quantity of liquids and for improving the shelf life, owing to replacement of the air inside the tray with an atmosphere composed of gases suitable for increasing the duration of the packaged product. The machines of the known type which use the aforementioned packaging technique are generally designed correspondingly. The trays containing the products are placed inside a counter-die, sometimes with several moulds, which reproduces the form of the perimeter of the said trays and supports them along the perimetral edge which remains free at the top. The closing film is positioned on the upper edge of the trays situated inside the counter-die, said film, when it is pre-printed and has images which must remain on the outer surface of the closed tray, being correctly synchronised or adjusted relative to the trays so that the printed image is always correctly positioned relative to the said trays. The counter-die with, inside it, the full trays covered by the film is positioned inside a hermetically sealed chamber inside which firstly a vacuum is formed by means of a pump and then the modified atmosphere, intended to replace the air, is introduced, so as to improve the so-called shelf-life of the product to be packaged. In phase sequence, inside the said process chamber, a hot die is moved downwards so as to sealingly weld the film onto the edge of the trays and punch the said film along the upper edge of the said trays, outside the welding bead. Opening of the process chamber reveals, inside the counter-die, the sealed packages containing the modified atmosphere. The counter-die is then cleared of the packages produced and the waste film and is then filled again with new trays with the product inside, and the cycle described is repeated.

This technique has the following limitations: considerable complexity in creating the vacuum before the modified atmosphere is introduced into the process chamber. The formation of the vacuum must be performed slowly since, with a reduction in the atmospheric pressure, there is a decrease in the boiling temperature of the liquids contained in the product being packaged. Rapid formation of the vacuum would result in boiling of the packaged food product, with an inevitable deterioration in its properties. For this reason, the processing chamber is usually suitably cooled. Another drawback consists in the fact that all the gases generated during heat-sealing inside the package inevitably remain trapped within the said package. In addition to all this, the structures which move the dies and the counter-dies and which apply the welding loads must be very rigid and precise, so as to ensure adequate and well-distributed pressure during welding over relatively large welding areas. These structures are therefore heavy and costly and inevitably specifically designed according to the shape or size of the trays used in each case. The machines are consequently costly and bulky and the setting-up times are very long when it is required to replace the dies and the counter-dies, both because of the difficulty in moving them and because of the time required to heat the counter-dies to the temperature necessary for heat-sealing.

In an attempt to overcome these drawbacks, machines have been devised for introducing the modified atmosphere into the tray with the product, using the technique of replacement by means of pressure, whereby the modified atmosphere is forced under pressure inside the tray with the product, so that the unwanted air is expelled outside the said tray and is replaced by the said modified atmosphere. In the U.S. Pat. No. 6,202,388, for example, the tray with the product is fed forwards horizontally and is positioned underneath the opening formed in a section of film after the punching step which has separated the lid of the previous tray which has been sealingly closed. Blades emitting a modified atmosphere act on the sides of the tray so as to prevent the entry of ambient air. The modified atmosphere is then blown into the tray, via said opening in the film, vertically and from above, by means of a nozzle which is very complex and which injects centrally a high-speed flow and a lower-pressure stream all around it. Before the film is fed forwards, in order to close with a complete portion thereof the upper mouth of the tray, which remains closed, the high-speed flow is interrupted and the low-speed flow is maintained, this isolating the end space around the product and preventing it from making contact with the external environment. When the film covers the tray completely, the gas supply is stopped and the portion of film which closes the tray is heat-welded to the perimetral edge of the said tray and is then punched all around and outside the weld, so as to separate the tray closed by the film and provide in the latter the opening for the next working cycle. With this technique it is possible to obtain extremely low residual oxygen values inside the package, in a sealing time of less than ten seconds. This solution poses the same problems as the known processes, owing to the presence of the welding dies with a form especially designed for that of the trays used, is not suitable for continuous working cycles and has the drawback that the gas which is emitted during the heat-sealing process from the internal perimeter of the lid fixed to the edge of the tray remains trapped inside the said tray. The invention intends to overcome these and other drawbacks of the known art, with a new method which is characterized by the following sequence of operating steps:

a) gradual application of a film unwound from a reel onto the upper edge of the tray with the product and gradual heat-sealing with this edge, starting from one side and from one end of the said tray and gradually proceeding until the other end or opposite side is reached, so as to close gradually and entirely in a sealed manner the said tray;

b) during the previous step, through a part of the upper mouth of the tray which until the last moment is not covered by the closing film and remains open, a modified atmosphere under pressure is blown inside and expels from the said tray the ambient air and the gases which form during welding and completely saturates the internal volume of the said tray, until the latter is completely closed by the film;

e) separation of the portion of film welded to the upper edge of the tray with the product and performing the function of a lid, by means of a cutting operation, outside of the welding bead and the said edge, so that the closed tray with inside the product under a modified atmosphere may be moved away from the said continuous film.

The characteristic features and advantages of such a method and the machine which implements it will become clear from the following description of a preferred embodiment thereof provided purely by way of a non-limiting example in the figures of the accompanying drawings in which.

Figure 1:
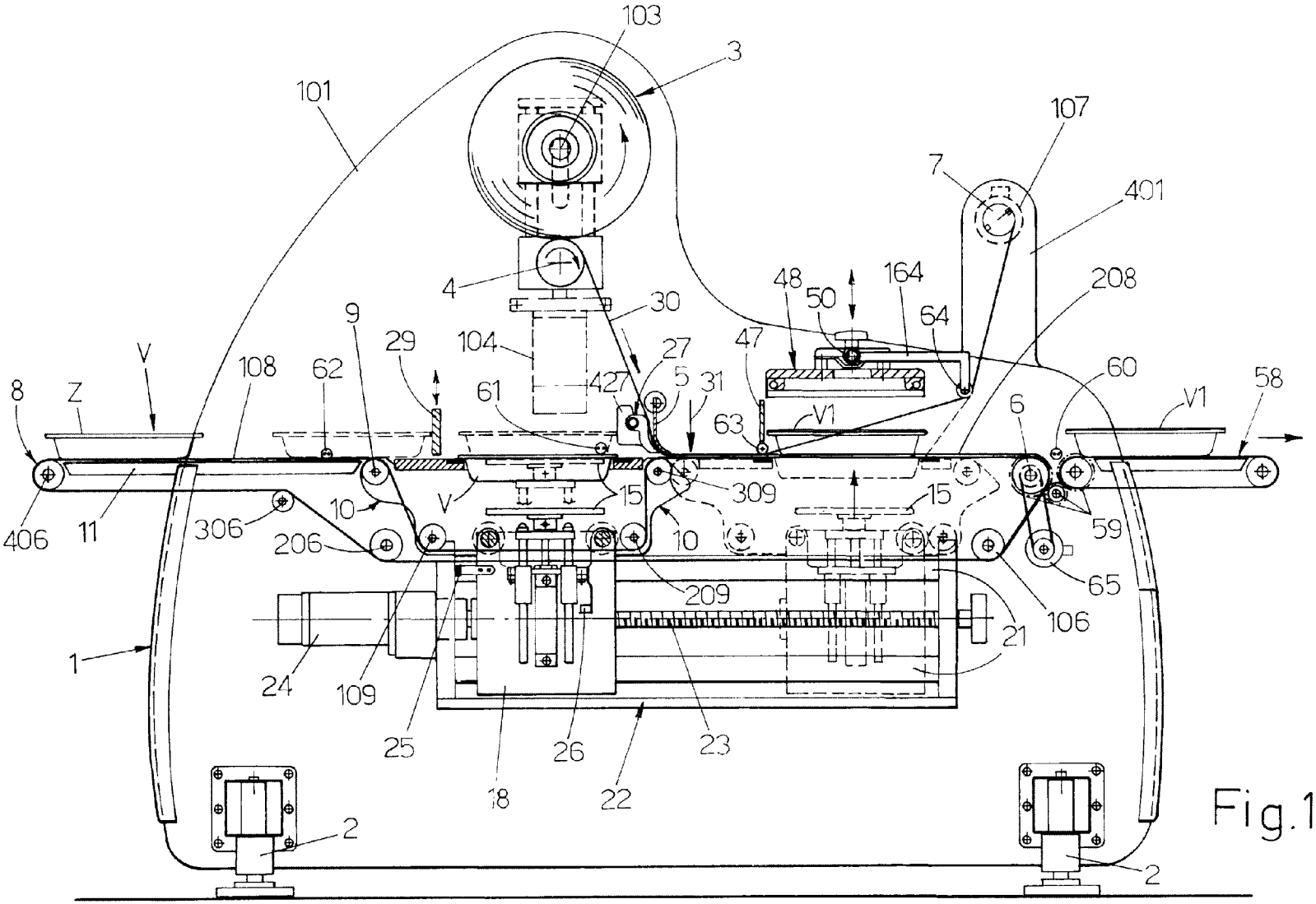
FIG. 1 is a side view, with parts cross-sectioned, of the machine.

From FIG. 1 it can be seen that the machine comprises a base structure 1 which rests on the ground with adjustable feet 2 and which extends upwards, beyond the working plane of the trays V containing the product, with a side-wall 101 which supports projecting and horizontally the spindle 103 for rotation of the reel 3 of thermoplastic film which is impermeable to gases or certain gases and which is unwound positively from the said reel for example by a tangential and rubber-lined roller 4 which is kept constantly in contact with the said reel by known means and is actuated by a motor 104 rotating in both directions, for example of the brushless type or other type which can be remotely controlled by an electronic unit, not shown, which manages automatic operation of the machine. The film 30 unwound from the reel 3 is conveyed downwards and to the height of the working plane of the trays V and is deviated on first deviating means 5 which may consist of a fixed guide which is curved at the bottom or one or more rollers and, from these means, the film continues approximately horizontally over a short section at the end of which it is deviated on second deviating means 63 consisting for example of a roller supported rotatably by the bottom edge of a transverse fixed vane 47, which will be described further below, following which the same film continues along an ascending and broken path, being deviated on third rollers 64 mounted on the structure movable vertically with the punching head 48 (see below) and then being fixed to a take-up beam 7 which is supported rotatably and in a projecting manner by a side lug 401 of the fixed frame of the machine and actuated by an associated motor 107 which is also of the brushless type and or type rotating in both directions or other type which can be precisely controlled by the control processor of the machine. The motors 104 and 107 are actuated with constant control of the torque and must be able to control the film both during forward feeding and during a small backwards movement on the working surface of the machine (see below), keeping the film itself always correctly stretched in the longitudinal direction. It is also possible to simplify control of the film by the motors 104 and 107, it being possible to arrange, between the roller 4 and the first deviating means 5, known means of the jockey wheel type, with suitable tensioning sensors, which provide extra play in a sufficient quantity of film and which could allow the said backward movement of the said film, only by reversing operation of the downstream motor 107 and which could also allow the use of an unwinding motor 104 also of the conventional type.

The trays V with the product, to be sealed with the film 30, are made of thermoplastic material and are therefore heat-weldable or may be made of non-thermoplastic material and be rendered heat-weldable with the addition of materials suitable for this purpose, for example heat-weldable surface films or thermal adhesives, at least on their perimetral and upper edge Z along which the aforementioned film 30 must be welded.

The horizontal path of the film 30 between the deviating means 5 and 63 is superimposed on the horizontal path of the trays V which are fed forwards at the start and at the end of the working cycle by means of a conveyor with belts 8 which are deviated over rollers 106, 6, 206, 306, 406 rotatably supported by the frame 1 of the machine, the downstream roller 6 being connected to a motor 65 controlled by the processor which controls operation of the machine in the manner described further below. The upper portion of the conveyor 8 has an intermediate depression with a length suitably greater than that of one of the larger size trays which can be processed by the machine and this depression arises from the fact that the belts of the said upper portion of the conveyor 8 are deviated over rollers 9, 109, 209, 309 (see also FIG. 2) which are freely rotatably supported by a carriage 10 which, by suitable means, may be displaced horizontally and moved from the position indicated by continuous lines in FIG. 1 to that shown in broken lines, at a short distance from the end deviating roller 6 and vice versa. The initial section 108 of the upper portion of the conveyor 8 travels over a flat structure 11 fixed to the frame 1 and has a length such as to support at least one tray V. The final section 208 of the upper portion of the conveyor 8 is instead free of underlying obstacles.

A horizontal and flat counter-die 12 fixed to the said carriage 10 is arranged in the depression created by the carriage 10 along the upper portion of the conveyor 8, said counter-die with its upper side being coplanar with the upper portion of the belts of the conveyor 8 so that a tray V is able to pass without difficulty from the initial section 108 of the belts to the said counter-die 12, as indicated below. Still with reference to FIGS. 1 and 2, it can be seen that the counter-die 12 has at least one opening 112 having a form and size correlated to that of the body of one of the trays V to be sealed, such that said tray is able to fit with its body into this opening and may rest with its upper edge Z on a portion of the counter-die 12 which surrounds the said opening 112 and which is lined on top with an insert 13 made of any suitable non-adhesive and sufficiently elastic material, for example silicone rubber.

Figure 2:
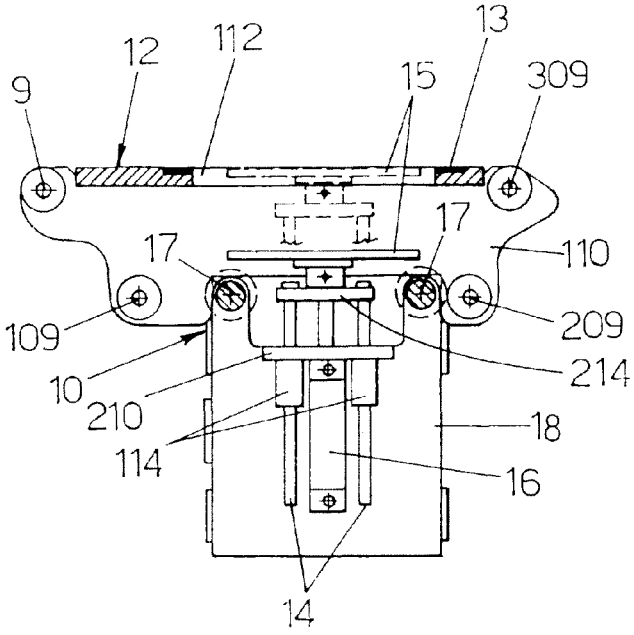
FIG. 2 shows, laterally and with parts cross-sectioned, the carriage of the machine which supports the tray during the whole closing cycle.
Figure 6:
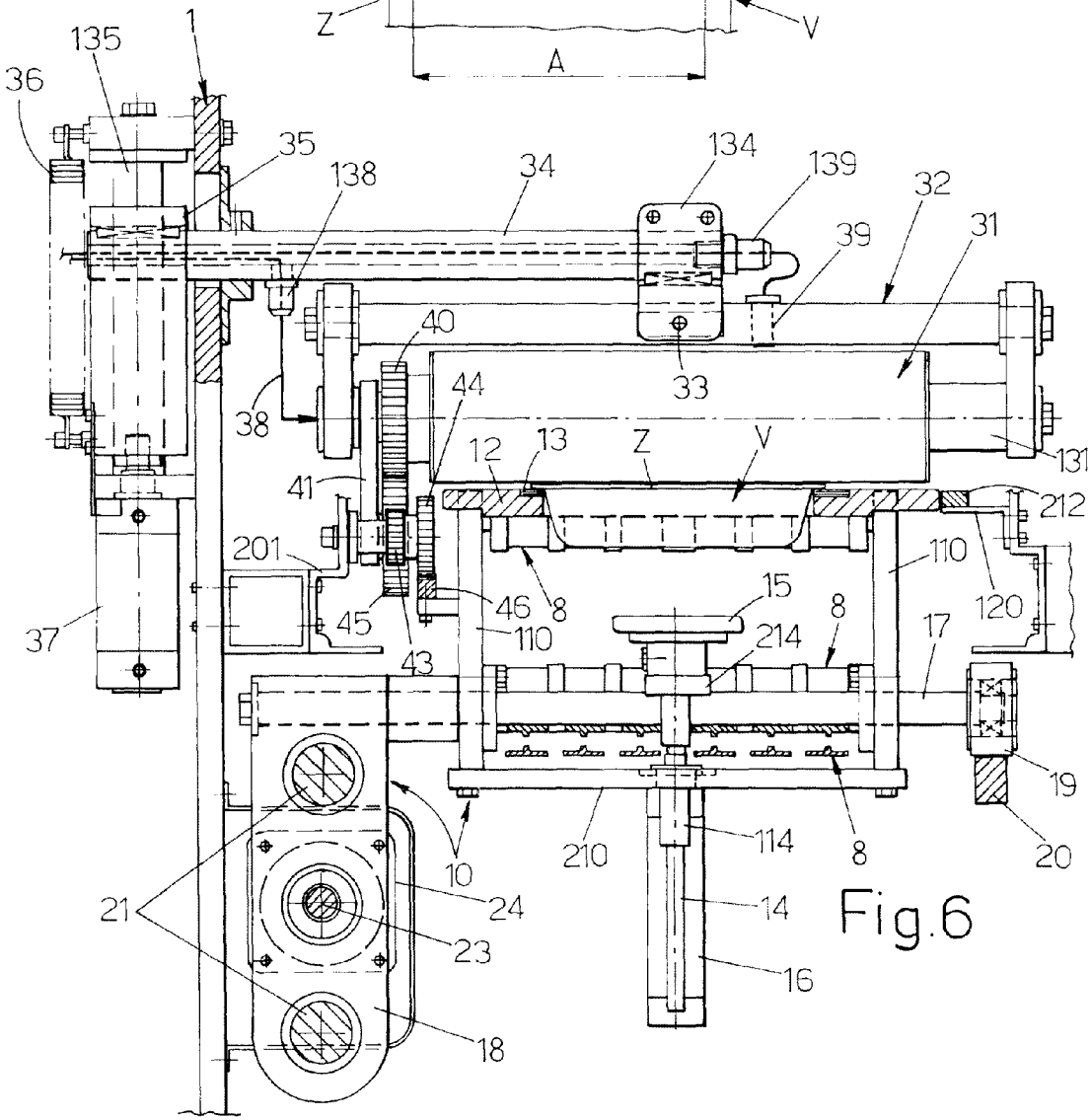
FIG. 6 is a cross-sectional view of the machine which shows the carriage with the counter-die for supporting and displacing the trays and with the overhead means for welding the film onto the upper edge of the said trays.

From FIGS. 1, 2 and 6 it can be seen that the carriage 10 is composed of a pair of side-walls 110 which support the said counter-die 12 in a manner such that it may be easily and rapidly interchanged with other counter-dies upon variation in the shape or size of the trays V to be sealed and the said side-walls are fixed together by means of cross-members which comprise a bottom cross-member 210 having, fixed thereto, a pair of vertical guides 114 inside which corresponding rods 14 slide, said rods being fixed at their top end to a cross-piece 214 having, mounted thereon, a raising plate 15 which, by means of a pneumatic cylinder and piston unit or other rectilinear actuator 16 fixed with its body to the said cross-member 210 and connected with its stem to the said cross-piece 214, may be actuated so as to be raised inside the opening 112, in a manner coplanar with the die 12, or may be lowered, as indicated in FIGS. 1 and 2 by broken lines and continuous lines, respectively. The side-walls 110 of the carriage 10 are fixed to the middle part of a pair of horizontal rods 17 which at one end are fixed to a slide 18 and which at the other end support rollers with bearings 19 sliding on a rail 20 fixed to the frame 1 of the machine, so as to ensure maximum stability of the counter-die 12 during the alternating forward and backward movements. 212 denotes a sensor which is supported by a support 120 fixed to the frame 1 of the machine and which, at the end of the active stroke of the carriage 10, is activated by the counter-die 12 and generates a consent signal for the punching step which involves the following station 48 (see below). The slide 18 (FIGS. 1, 6) slides with suitable means on a pair of horizontal rods 21 which are fixed at the ends to a frame 22 which is in turn fixed to a side-wall of the base 1 of the machine and on which there is rotatably mounted, parallel to the said rods 21, a screw 23 which co-operates with a female thread seated inside the slide 18 and which may be rotated in both directions and at an appropriate speed by a drive unit 24 which is also fixed to the frame 22 and has an electric motor for electronic speed and phase control, for example of the brushless type or other suitable type which can be precisely managed by the machine processor. 25 and 26 denote in FIG. 1 sensors which respectively detect the rest position of the carriage 10 and the high position of the raising device 15.

Figure 5:
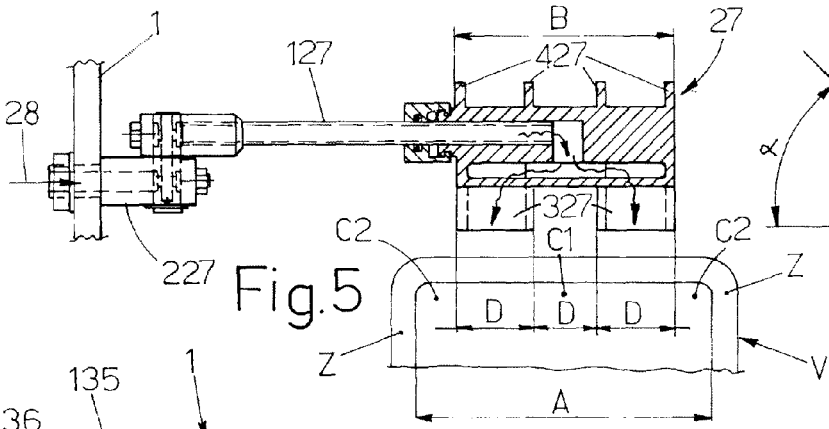
FIGS. 4 and 5 show, cross-sectioned and viewed laterally and partly sectioned longitudinally and viewed from above, the nozzle means which blow the modified atmosphere into the trays.
Figure 4:
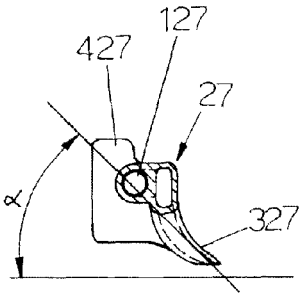

A nozzle device 27 is provided immediately upstream of the first deviating means 5 and the film 30 which passes over the latter (FIG. 1), said device blowing the modified atmosphere into the tray V which passes below it so as to expel from the said tray the air with the oxygen and replace the latter. From FIGS. 4 and 5 it can be seen that the blower 27 is, for example, composed of a horizontal and hollow bar 127 which at one end is fixed to support means 227 fixed to a side-wall of the frame 1 of the machine and designed to ensure connection to the means supplying the modified atmosphere under pressure, schematically indicated by the arrow 28. The said bar 127 is parallel to the said first film deviating means 5 and has, fixed on its projecting end, a pair of nozzles 327 which receive in equal amounts the atmosphere supplied by the said bar and are characterized by a curve form with a concavity directed towards the said deviating means 5 and by the fact that they terminate at a short distance from the upper mouth of the trays which pass underneath them and are characterized in that their bottom discharge mouth forms a suitable angle with respect to the horizontal surface, preferably between 10° and 50°, for example about 30°. From FIG. 5 it can be seen that the nozzles 327 have an identical width D and are preferably spaced from each other by an amount substantially equal to the said width D, while the space B occupied, in plan view, by the set of two nozzles 327 is suitably less than the internal width A of the tray V and the said set of nozzles is symmetrically arranged in the plan-view projection of the tray, all of which so that the two flows of modified atmosphere supplied by the nozzles, after filling the internal and gradually increasing volume of the tray which advances and is gradually covered by the film 30, are able to flow back through the empty side spaces C2 and through the empty middle space C1, preventing any entry of ambient air into the said tray. The blower 27 is provided on the front side facing the front end of the conveyor 8 with a plurality of parallel reliefs which form a barrier 427 against which a tray V cyclically stops and in this condition is, with its body, correctly centred with the opening 112 of the counter-die 12 when it is in the start-of-cycle position.

Figure 3:
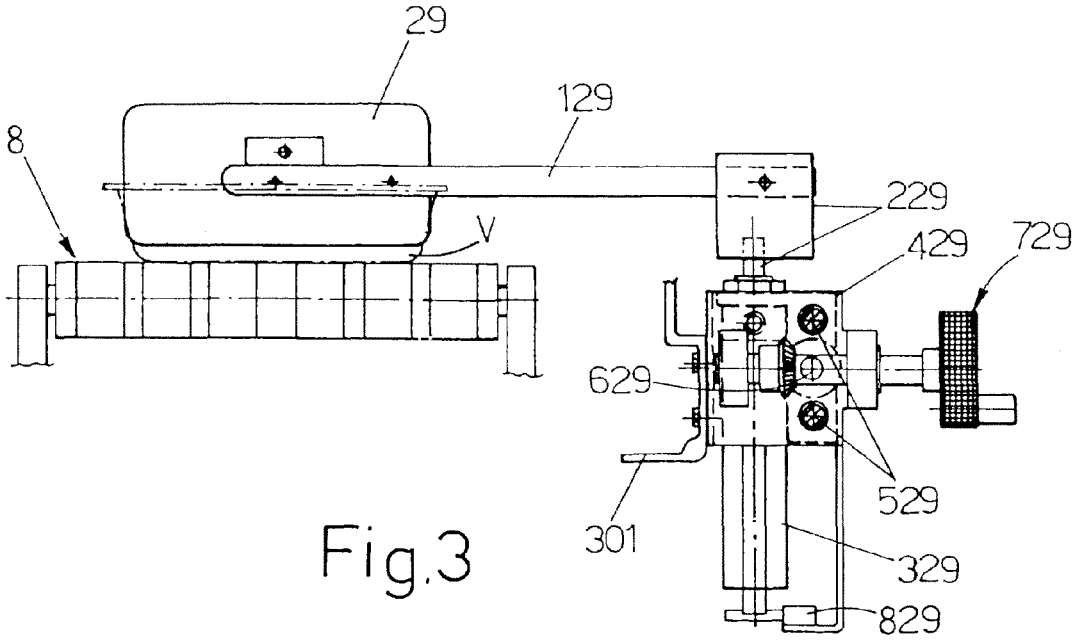
FIG. 3 is a front view of the vane which stops the product in the station for loading into the displacement die.

A vane 29 arranged parallel to the deviating roller 5 is envisaged upstream of the opening 112 of the counter-die 12, whenever the latter is in the start-of-cycle position (FIG. 1), said vane being associated with adjusting means which allow it to be positioned immediately downstream of the tray which cyclically reaches the stops 427. With reference also to FIG. 3 it can be seen that the vane 29 is supported by an arm 129 mounted on a vertical slide 229 actuated by a pneumatic cylinder 329 which in synchronism is able to bring the said vane into the raised position which allows a tray to pass underneath it and then into the lowered stop position of the said trays (see below). The guide 429 on which the said slide 229 travels is in turn slidable on a pair of horizontal guides 529 parallel to the longitudinal axis of the conveyor 8 and fixed at their ends to a part 301 of the frame 1 of the machine. The position of this slide 429 on the guides 529 may be adjusted as required by means of a screw/female thread system 629 which can be operated manually by means of the bevel gear pair operating system with handwheel 729. 829 denotes the sensor which detects the low position of the vane 29.

Figure 8:
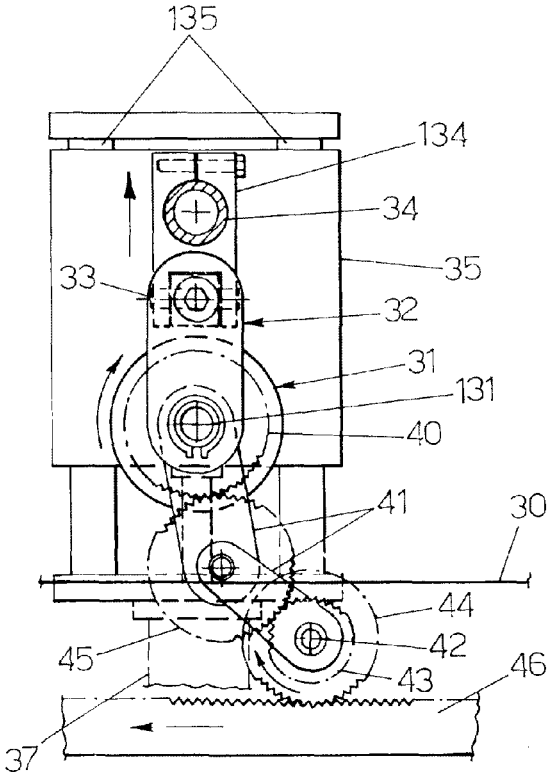
FIGS. 7 and 8 show laterally the mechanism which derives rotation of the film welding roller from the carriage displacement movement, the said welding roller being shown respectively in the low working position and in the high rest position.
Figure 7:
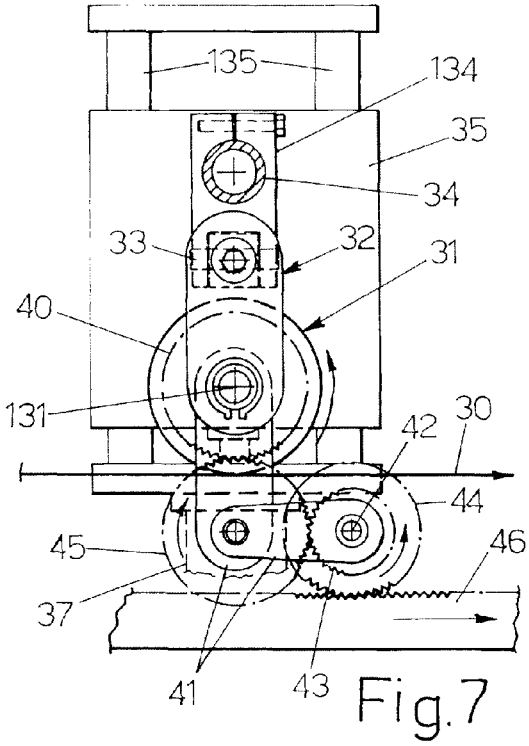

Any suitable means schematically indicated by the arrow 31 are envisaged immediately downstream of the first means 5 for deviating the film 30 (FIG. 1), said means, when the tray covered by the film passes underneath them, performing heat-sealing of the said film onto the perimetral edge Z of the tray so as to close the said tray in a sealed manner. The means 31, as shown in FIGS. 6, 7 and 8, preferably consist of a roller 31 with a round cross-section parallel to the deviating means 5 and suitably wider than the width of the trays V to be sealed, including the edge Z, this roller being heated to the appropriate temperature for example by internal electric resistances which are controlled by special temperature-measuring probes (see below) and being lined externally with a suitable non-adhesive material, for example as described in a separate patent application in the name of the same Applicants. With its spindle 131, the roller 31 is rotatably supported by a small overturned gantry 32 which in the middle of its beam is pivotably mounted transversely at 33, with the possibility of performing a small oscillating movement, on a fork member 134 fixed to the end of an arm 34 which is parallel to the roller 31 and at the other end is fixed to a slide 35 which is slidable on a vertical guide 135 in turn fixed to the frame 1 of the machine and biased upwards by a spring 36 and which may be lowered by a cylinder and piston unit 37 fixed with its body to a cross-beam of the said guide 135 and connected to means which, during the active working phase of the welding roller, supply it with air at appropriate pressure values. The welding roller in this way is able to act on the surface to be welded with the pressure necessary for correctly performing heat-sealing and may be adapted to this surface even if the latter is not absolutely flat. 38 denotes the electric power supply cable for the internal electric resistances of the roller 31, while 39 denotes a temperature-measuring probe which detects the heat emitted by the said roller and which controls operation of the heating resistances of this component. 138 and 139 denote cable muffs joined at their ends to the arm 34 which is axially hollow for allowing the electric cable 38 and the cable for the probe 39 to pass through. It is understood that the roller 31 may be heated using any technique also different from that indicated, provided that it is suitable for the purpose.

One end of the roller 31 has, keyed thereon, a toothed wheel 40 and, hinged thereon, the end of a toggle 41 pivotably hinged at the other end, at 42, with a part 201 which is fixed to the frame 1 of the machine and which supports on this pivoting hinge 42 rotatable and integral with each other a pair of toothed wheels 43 and 44, the outer one 43 of which meshes with an idle wheel 45 which is rotatable on the hinged joint of the toggle 41 and meshes with the toothed wheel 40 of the roller 31, while the internal toothed wheel 44 meshes permanently with a horizontal rack 46 fixed laterally to a side-wall of the carriage 10. The diameter of the toothed wheels 40, 45, 43, 44 is related to the external diameter of the roller 31 so that, when the carriage 10 performs its active working stroke with displacement to the right when viewing FIG. 1 and as shown in FIG. 7, the roller 31 rotates in an anti-clockwise direction so as to accompany the carriage during this displacement and rotates at a peripheral speed equal to the linear advancing speed of the said carriage 10.

Figure 9:
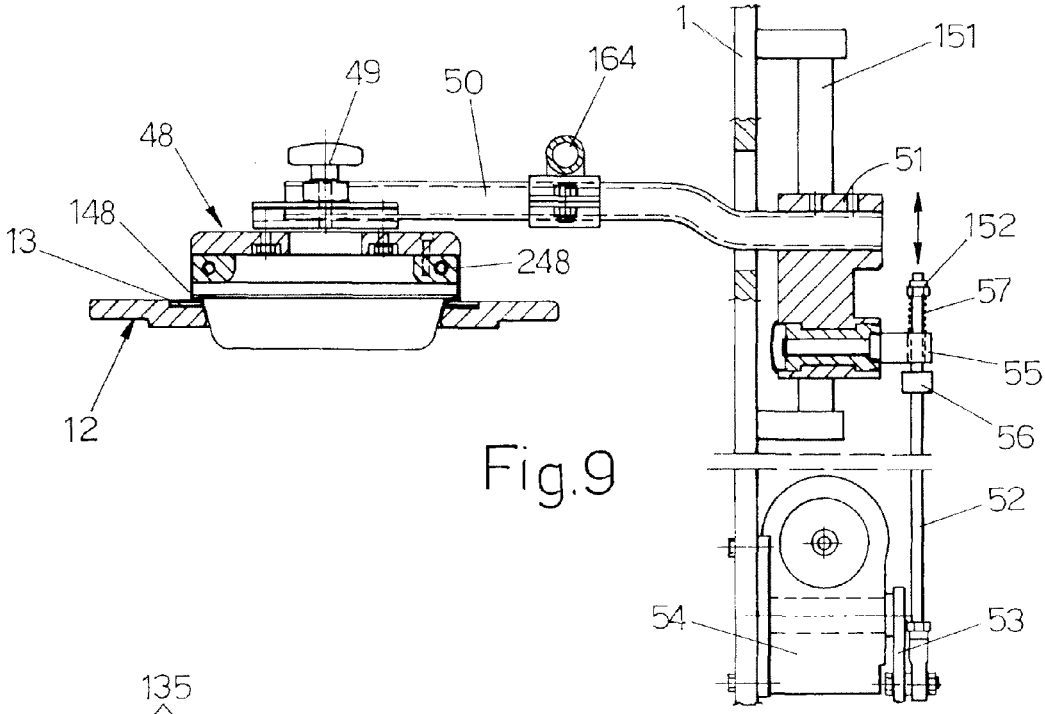
FIG. 9 is a front view, with parts cross-sectioned, of the punching die with the associated movement and take-up means in the working position on a closed tray.

From FIG. 1 it can be seen that, downstream of the welding roller 31, a vane 47 is positioned transversely above the horizontal path of the film 30 and that, differently from the upstream vane 29, it is fixed in the position where it is located. The position of the vane 47 is correlated to the greater size of the trays which the machine is able to process. Immediately downstream of this vane 47, above the path of the film 30, a punching die 48 is provided, said die being directed downwards with its cutting punch 148 which forms a rim able to circumscribe the edge Z of the tray V supported by the counter-die 12 at the end of its active displacing stroke. The punch 148 may be profiled with its active edge in any manner suitable for the purpose and may be heated by electric resistances 248 embedded in the metal rim which supports the said punch and in this case temperature-measuring probes (not shown) which control the power supply of the said resistances are provided. As shown also in FIG. 9, the punching die 48 is supported with means 49 which allow rapid replacement thereof, by the end of an arm 50 which at the other end is fixed to a slide 51 which is slidable on a vertical guide 151 in turn fixed to a side-wall of the frame 1 of the machine and which in synchronism may be raised and lowered by means of a connecting rod 52 and a crank 53 actuated by a drive unit 54 fixed to the frame 1 and controlled by the machine processor. The connecting rod 52 passes slidably through a hole provided on a pin 55 mounted rotatably on the slide 51 and this pin normally rests on a stop 56 fixed onto the said connecting rod which projects at the top from the said pin 55 with a portion supporting a spring 57 situated between the end 152 of the said connecting rod and the said pin 55. Consequently, as a result of the weight of the die 48 and the slide 51, the pin 55 rests constantly on the stop 56. Only, when at the end of the downward stroke of the die 48, its punching rim 148 touches the film and presses it against the insert 13 of the counter-die 12, does the connecting rod 52 continue to travel a small distance downwards and stress the spring 57 which pushes the die 48 downwards with a force such as to keep the film undergoing the punching operation firmly gripped, as will be explained more fully further below. The arm 164 which rotatably supports the roller 64 for deviating the film downstream of the punching head 48 is supported by the arm 50 of FIG. 9.

The machine is completed (FIG. 1) by an unloading conveyor 58 which is situated downstream of the conveyor 8 and is aligned and coplanar with the latter and also supported by the frame of the machine and which is connected kinematically to the deviating roller 6 by means of a gearing 59. A photocell 60 detects the passing movement of a tray between the conveyor 8 and the conveyor 58, while a photocell 61 is envisaged for detecting the presence of a tray in front of the barrier 427 of the blower 27 and another photocell 62 is envisaged upstream of the vane 29, for detecting the presence of a tray against this component, as described further below.

Figures 10, 11, 12:
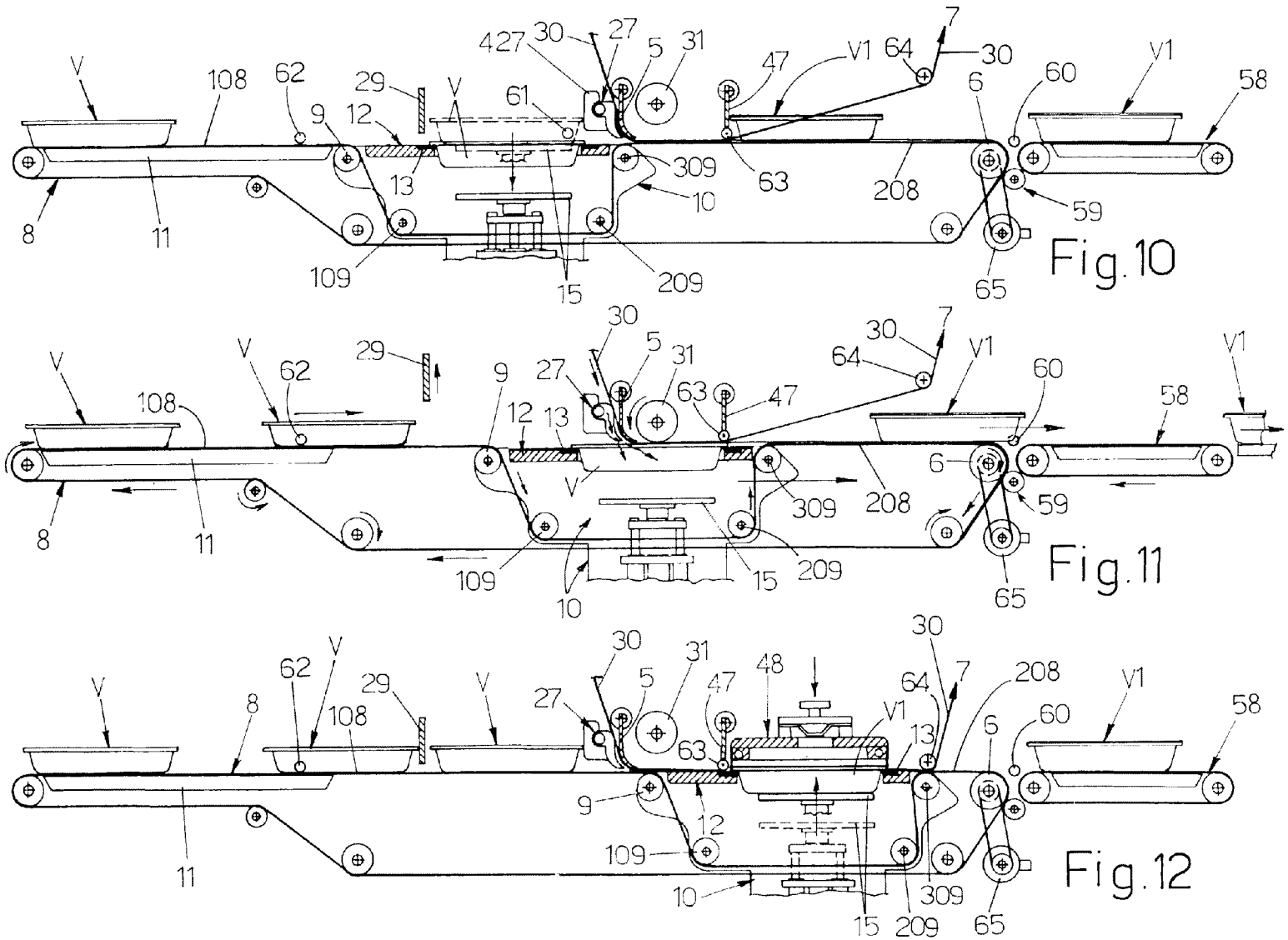
FIGS. 10, 11, 12, 13 and 14 show, laterally and with parts sectioned, the main components of the machine during successive steps of the working cycle of the said machine.
Figure 13:
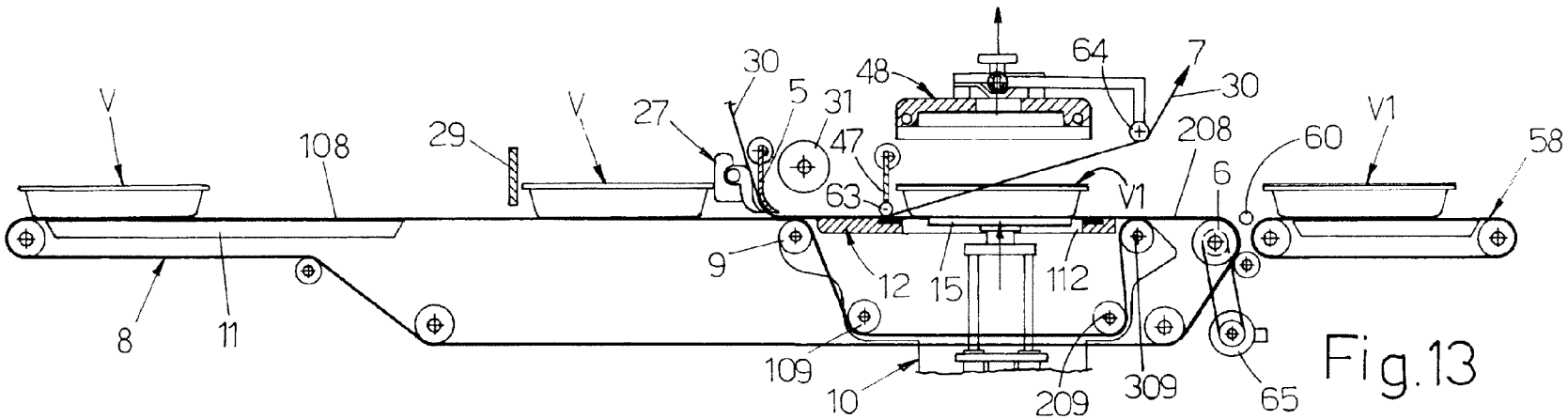

The machine, as described, functions in the following manner. At the start of each working cycle, the carriage 10 is in the position illustrated by a continuous line in FIG. 1 and as shown in FIG. 10, with the raising device 15 in the high position, with the conveyor 8 active and with the vane 29 which in synchronism is raised so as to allow a tray to pass through and which is then lowered when this tray reaches the stops 427 of the blower 27 which is temporarily immobile and is detected by the photocell 61. Resting against the transverse stops 427 and pushed underneath by the belts of the conveyor 8, the tray touches the said stops in a uniform and equally distributed manner with its front side and in this way is correctly aligned for the following feeding step. After this step, the motor 65 stops and halts the conveyor 8. During this automatic machine loading step, the welding means 31 and punching means 48 remain in the high rest position. When the carriage 10 reaches the aforementioned start-of-cycle position, if a tray is not present against the stops 427, the said carriage 10 starts again immediately, under no load, being displaced to the right when viewing FIG. 1, in order to keep the welding roller 31 rotating, so as to ensure that its temperature remains uniform at the predefined values, also because, owing to its nature, heat tends to rise. If, on the other hand, a tray is present in the vicinity of the photocell 62, when the carriage 10 reaches the start-of-cycle position, the machine proceeds in the following manner. From FIG. 10 it can be seen that the raising device 15 is lowered and the tray V fits with its body into the seat 112 and with its edge Z rests on the insert 13 of the counter-die 12. The photocell 61 detects this descending condition of the tray and the cycle continues with activation of horizontal displacement, to the right, of the carriage 10, as shown in FIG. 11, with lowering in synchronism of the roller 31 which rotates and welds the film 30 onto the upper edge Z of the tray V, while the motor 104 for unwinding film from the reel and the motor 107 for taking up the waste film downstream (FIG. 1) start to rotate in synchronism so as to feed the said film in time with the tray and so as to keep it suitably stretched. In synchronism with welding of the film onto the edge Z of the tray, the blower 27 starts functioning and introduces modified atmosphere into the said tray and expels the ambient air and the gases which form during the said welding operation. The speed of displacement of the carriage 10 with the tray is such that the welding may be performed correctly and at the same time the atmosphere inside the said tray may be fully replaced. While the tray and the film move towards the right as viewed in FIGS. 1, 10 and 11, the motor 65 may be activated and the vane 29 may be temporarily raised so that the machine may be automatically loaded with a tray for the next working cycle, as already mentioned above, and also so as to activate the conveyor 58 for unloading, if present, a tray V1 sealed during the previous working cycle. At the end of displacement of the carriage 10 towards the right (FIGS. 11, 12), the tray V situated on the die 12 has been closed on top with the film and is now centred with respect to the punching die 48 which is in the raised position. The blower 27 has stopped functioning, the welding roller 31 is raised in synchronism and with stoppage of the carriage 10 the film feeding means 30 also stop. In synchronism, the punching die 48 is lowered into the low position and with its punch 148 grips the portion of film outside the weld and the upper edge of the sealed tray V1 on the non-adhesive and elastic insert 13 of the counter-die 12, while in synchronism, as shown in the sequence of FIGS. 12 and 13, the raising device 15 is raised and lifts the sealed tray so that the film is cut by the punch 148 as a result of the combination of the compressive force of the latter on the said film and the tensile force exerted by the tray which is raised by the raising device 15, while the same film is retained between the said punch and the insert 13 of the counter-die 12. It is clear how, as a result of the combination of the aforementioned operations, the punch 148 is able to perform cutting, also in the cold state, for example using a suitable cutting and sawtooth profile. Following raising of the raising device 15, the punching die 48 is also raised in to the rest position, as can be seen from FIG. 13, while the sealed tray V1 remains positioned above the counter-die 12, resting on the raising device 15 which stops in the upper end-of-travel position coplanar with the said counter-die 12. During raising of the punching die 48, the deviating roller 64 is raised together with it, the film is kept tensioned by the take-up beam 7 and the waste portion of the said film which passes between the said roller 64 and the bottom roller 63 of the vane 47 is raised at an angle which favours the subsequent unloading displacement of the sealed tray V1.

Figure 14:
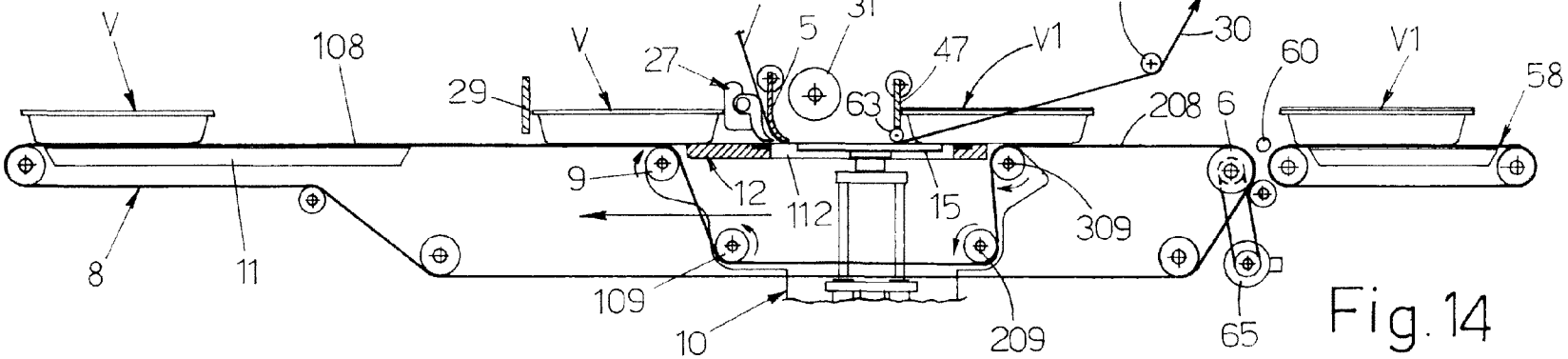

As shown in the sequence of FIGS. 13 and 14, the carriage 10 is then displaced towards the left, while the belts of the conveyor 8 remain at a standstill or may be temporarily activated by the motor 65, so as to load a tray against the stops 427. During this step the sections 208 and 108 of the upper portion of the conveyor 8 are lengthened and shortened, respectively. While the counter-die 12 moves towards the left, the tray V1 which has been sealed during the previously considered cycle and which has been separated from the film by the punch 48 is retained inside the punching station by the fixed vane 47 and at the end of the said displacement the said counter-die 12 with the raising device 15 in the high position is arranged underneath the tray V to be sealed which is retained by the movable vane 29 and which is correctly oriented also by this component.

During the return stroke of the carriage 10, the motors 104 and 107 driving the film are activated so as to move the said film backwards by an appropriate amount and so as to move sufficiently towards the first deviating means 5 the opening created in the film by the previous operation for punching the lid onto the previously sealed tray V1, so as to minimize the amount of waste film. This operation may be controlled by the machine processor and may if necessary be assisted by optoelectronic sensors in the case where the film is of the preprinted type and has special reference symbols. After these operations, the raising device 15 is lowered so as to insert the new tray V into its seat 112 and the cycle described is repeated, while the packaged tray V1 which was in front of the fixed vane 47 is transferred onto the unloading conveyor 58 upon initial activation of the main conveyor 8. The photocell 60 detects the passage of the tray being unloaded and signals a regularly functioning event to the machine processor.

It is easy to appreciate the advantages which arise from having replaced the welding die according to the known art with means which are able to handle different size trays and which subject the counter-die 12 to pressures which are lower than those of the known art and which are suitable for operation with continuous working cycles. It is also easy to appreciate the advantage which arises from the possibility of eliminating from inside the packaged article the gases which are formed during the welding process since, until the last moment of this cycle, the packaged article is internally "washed" by the flow of modified atmosphere. When there is a change in the shape or size of the trays, it is required to replace the counter-die 12 and the punch 48 which are simple and inexpensive components of the machine and which, if necessary, may be designed with a variable form for rapid adaptation to the trays of varying size. According to another constructional variant, the welding roller 31 may be equipped with a small electric motor (not shown) which keeps it rotating also when the carriage 10 is in the rest position, so as to prevent idle movements of the machine in the case where a tray is not immediately available in the loading station when the carriage 10 returns into the start-of-cycle position. According to another variant, finally, the counter-die 12 and the punch 48 may be structured so as to operate on several trays arranged alongside each other, in particular if they are of small shape or size, so as to increase the productivity of the machine.

The machine can be used also for sealing trays without a modified atmosphere, in which case the blower 27 is not used or may be used only to expel from the tray the gases which are formed during welding of the covering film.

The invention claimed is:

1. A machine for packaging food products in trays which are sealed at the top with thermoplastic film, said machine comprising:

a reel and film feeding means for controlled unwinding therefrom of film for closing the trays, the reel of film arranged with a horizontal axis thereby allowing the film to be unwound from the reel;

first deviating means situated below the reel and around which the film is deviated for changing a path of the film from a descending path to a horizontal path, the first deviating means comprising a fixed guide curved at the bottom and one or more rollers;

second deviating means for altering a path of the film;

rollers mounted on a vertically movable structure supporting a punching head on one end and fixed to a take-up beam supported rotatably in a projecting manner by a lug of a fixed frame of the machine on another end, the rollers being actuated by a roller motor, the roller motor, together with a film feeding motor, are actuated with constant control of torque wherein the film can be first stretched above the tray to be closed and then the film feeding motor can perform a small backward cyclical movement in order to limit the longitudinal waste of the film which during this step is also kept suitably stretched;

counter-die means for supporting at least one tray horizontally, along an upper edge, with a predefined orientation and for displacing it horizontally underneath a horizontal section of film;

welding means situated downstream of the first deviating means for welding the film sealingly onto an upper edge of the tray;

means situated upstream of the first deviating means for blowing an appropriate quantity of modified atmosphere at appropriate pressure values into an open part of the tray which advances underneath the film until the tray has been completely sealed by the film;

separating means for separating from the film, a portion of the film welded to the upper edge of each tray;

collecting means for taking up the waste film produced by the separation means, the collecting means operating in conjunction with the film feeding means, whereby at least the section of film on the horizontal path advances continuously stretched both longitudinally and transversely;

positioning means which at a start of a cycle supply and position correctly the trays to be closed in the counter-die means;

lifting means which at an end of the cycle, raise the closed trays from the counter-die means;

tray conveying means for conveying away the closed trays; and means for horizontally moving the counter-die means, which at the end of the cycle are adapted to bring the counter-die means back into a starting position for repetition of a new working cycle.

2. The machine according to claim 1, further comprising jockey wheel means disposed between the film feeding means and the first deviating means, with tensioning sensors, which provide extra play in a sufficient quantity of film to allow the small backward movement of the film, only with reversal in operation of the roller motor and so as to allow the use of the film feeding motor.

3. The machine according to claim 1, wherein closing trays are not subject to a modified atmosphere, wherein the blower is used to blow in clean air in order to remove from the tray the gases which are formed during welding of the film for closing the tray.

4. The machine according to claim 1, further comprising a vane provided transversely with respect to the path of the trays, upstream of the opening of the counter-die when the vane is stationary in a start-of-cycle position, the vane being associated with adjusting means, wherein, upon a variation in the shape or size of the trays, allow positioning of the vane immediately downstream of the tray which cyclically comes up against the barrier of the means for blowing the modified atmosphere and being associated with raising and lowering means which, when actuated, bring the vane from a low position for intercepting the trays to a high position which allows the trays to pass through and vice versa.

5. The machine according to claim 4, wherein the vane is supported by an arm mounted on a vertical slide actuated by a rectilinear actuator which in synchronism can bring the vane into the raised position, thereby allowing a tray to pass underneath it and then into a low stopped position of the trays, the machine further comprising a guide on which the vertical slide travels, the guide slidable on a pair of horizontal guides parallel to the longitudinal axis of a main conveyor and fixed at the ends to a part of the frame, a position of the vertical slide, on the horizontal guides, adjustable by means of a suitable system.

6. The machine according to claim 1, wherein, when the tray covered by the film passes thereunderneath, the welding means is adapted to heat-weld the film onto a perimetral edge of the tray, to close the tray in a sealed manner, the welding means comprising a welding roller with a round cross-section, parallel to the first deviating means, with a width suitably greater than the width of an upper edge of the trays to be closed, heated to an appropriate temperature, the welding roller being supported by raising and lowering means which, when actuated, is adapted to transfer the welding roller from a raised rest position to a low position where it makes contact an appropriate pressure on the film to be welded and being provided with rotation means which, during an active working phase, cause the weld roller to rotate at a peripheral speed identical to a linear speed of feeding of the tray with the film and in the same direction.

7. The machine according to claim 6, in which the welding roller may be actuated by a small electric motor which causes the welding roller to rotate during an active phase and/or at least when a carriage for conveying the tray is in the rest position, so as to avoid idle movements of the machine in the case where a tray is not immediately available in the loading station when the carriage returns into a start-of-cycle position.

8. The machine according to claim 6, wherein ends of the welding roller rotatably support the welding roller by a gantry, the gantry having a middle portion connected, via a cross-pin, to a fork member fixed to an end of an arm which is parallel to the welding roller and which at an other end of the arm is fixed to a slide which is slidable on a vertical guide which is fixed to the frame and biased upwards by a spring and which is adapted to be lowered by a rectilinear actuator comprising a cylinder and piston unit fixed with its body to a cross-member of the guide and connected to means which, during the active working phase of the welding roller, supply it with air at appropriate pressure values.

9. The machine according to claim 8, further comprising a fixed vane positioned downstream of the welding roller transversely above the horizontal path of the film and, differently from an upstream vane, the fixed vane being in a fixed position which is correlated based on a largest size of the trays which the machine is able to process.

10. The machine according to claim 8, wherein the arm is axially hollow so that it may be passed through by cables powering and controlling the welding roller, the cables passing through cable muffs and joined at their ends to the rotational means of the welding roller and to a probe mounted on the gantry and directed towards the welding roller, for detecting the operating temperature thereof.

11. The machine according to claim 10, in which one end of the welding roller has, keyed thereon, a toothed wheel, and hinged thereon, a first end of a toggle hingedly attached to the toothed wheel, and a second end of the toggle pivotably hinged to a part which is fixed to the frame, the part supporting a pair of toothed wheels rotatable and arranged integrally alongside each other, an outer one of the pair of toothed wheels meshing with an idle wheel which is situated on a hinged joint of the toggle and which meshes with the toothed wheel of the welding roller, an inner one of the toothed wheels meshing permanently with a horizontal rack fixed laterally to a side-wall of a carriage, a diameter of the pair of toothed wheels being related to an external diameter of the welding roller so that, when the carriage performs an active working stroke, the welding roller rotates in a direction for accompanying the carriage during displacement and at a peripheral speed equal to the linear advancing speed of the carriage.

12. The machine according to claim 1, wherein the separation means comprises a punching die supported by a raising and lowering means and directed downwards with a cutting punch which forms a rim able to circumscribe an edge of the closed tray supported by the counter-die at an end of its active displacement stroke, the cutting punch operatable in both a cold state or a heated state, the heated state provided via electric resistances embedded in a metal rim which supports the cutting punch, and temperature-measuring probes for controlling a power supply of the resistances according to predefined parameters.

13. The machine according to claim 12, wherein the punching die is supported with means which allow rapid replacement thereof, by one end of an arm which at the other end is fixed to a slide which is slidable on a vertical guide fixed to a side-wall of the frame and which in synchronism may be raised and lowered by means of a connecting rod and a crank actuated by an actuator fixed to the frame and the motor of which is controlled by a processor the connecting rod passing slidably through a hole provided in a pin mounted rotatably on the slide and the pin resting on a stop fixed onto the connecting rod which projects above from the pin with a portion supporting a spring situated between an end of the connecting rod and the, pin, wherein, as a result of the weight of the die and the slide, the pin rests constantly on the stop, whereas when, at the end of the downward stroke of the die, a punching rim of the die touches the film and presses the film against the insert of the counter-die, the connecting rod continues to travel a small distance downwards and stresses the spring which pushes the die downwards with a force such as to keep the film undergoing the punching operation firmly gripped.

14. The machine according to claim 13, further comprising means for ensuring that, in synchronism with the downward movement of the punching die, when the cutting punch grips a portion of film outside a weld and an upper edge of the tray onto a non-adhesive and elastic insert of the underlying counter-die, the lifting means is raised so as to raise the closed tray so that the film is cut by the cutting punch as a result of the combination of a compressive force of the cutting punch on the film and a tensile force exerted by the tray which is raised by the lifting means, while the film is retained between the cutting punch and an insert of the counter-die wherein, in sequence with raising of the lifting means, the punching die is also raised into a rest position, while the closed tray is positioned and kept above the counter-die by the lifting means which stops in an upper end-of-travel position.

15. The machine according to claim 1, further comprising an unloading conveyor downstream of the main conveyor, coplanar with the main conveyor, which is also supported by the frame of the machine and is connected kinematically to an end deviating roller of the main conveyor, by means of a gearing such that the unloading conveyor and the main conveyor are synchronized, in the same direction and at the same speeds.

16. The machine according to claim 15, further comprises photocell means which detect the passing movement of a tray between the main conveyor and the unloading conveyor and other photocell means for detecting the presence of a tray in front of the barrier of the blower and photocell means for detecting the presence of a tray against a movable vane, upstream of the moveable vane, the photocell means being connected to a processor so as to transmit to the processor the information relating to the presence or absence of the trays.

17. The machine according to claim 16, further comprising means so that, at a start of each working cycle, a carriage is situated upstream of the welding means with the lifting means in a high position, and means for ensuring that the machine, with correlated movements for activation of the conveyor and raising and lowering of a movable vane, may be automatically loaded with a tray which stops with a front side of the movable vane against the barrier of the blower which is now inactive, so as to be aligned correctly with its longitudinal axis relative to that of the conveyor, so as to ensure correct and future entry of the tray into a seat of the counter-die, and the conveyor stops and the movable vane remains in the low position when the loaded tray is detected by the specific photocell situated upstream of the blower and when an upstream tray reaches the movable vane and is detected by the specific photocell.

18. The machine according to claim 17, further comprising means so that, at the start of each operating cycle, the lifting means is lowered and the tray enters into the seat of the counter-die, while the specific photocell detects this condition and the cycle continues with raising of the vane and with activation of a horizontal displacement to the right of a carriage for conveying the trays, with lowering of the welding roller which rotates and welds the film onto the upper edge of the tray, while motors for unwinding the film from the reel and taking up the waste film downstream start to rotate in synchronism thereby feeding of the film in time with the tray and so as to keep it suitably stretched, wherein synchronism with welding of the film onto the tray, the blower is activated so as to introduce into the tray modified atmosphere which expels the ambient air and the gases which form during a welding operation.

19. The machine according to claim 18, further comprising means so that, during an active working stroke of the carriage, the main conveyor may be activated and the movable vane may be in synchronism raised and then lowered, for loading a subsequent tray upstream of the blower, while a final section of the main conveyor is shortened and expels any tray previously formed in the punching station towards the unloading conveyor which during this phase is also activated by rotation of the gearing for connection to the end roller of the main conveyor.

20. The machine according to claim 19, further comprising means, as a result of which, a speed of displacement of the carriage with the tray is such that the welding may be performed correctly and at the same time the gases inside the tray may be fully replaced.

21. The machine according to claim 19, further comprising means such that, at the end of an active displacement stroke of the carriage, when the tray situated on the counter-die has been closed above by the film and is centred with respect to the punching die which is in the raised position, the blower is deactivated in synchronism, the welding roller is raised in synchronism and the film feeding means are stopped, while in synchronism the punching die is lowered and is then raised following raising of the lifting means which positions the closed tray above the counter-die and remains in this position.

22. The machine according to claim 21, further comprising means so that, after raising of the lifting means, the carriage is displaced into a start-of-cycle position, while belts of the main conveyor are activated if it is required to replenish a tray upstream of the blower or otherwise remain at a standstill, while downstream and upstream sections of an upper portion of the main conveyor are lengthened and shortened respectively, wherein at the end of this displacement the counter-die with the lifting means still in a high position are arranged underneath the tray to be closed, which is retained between the movable vane and the blower and which is correctly oriented also by the movable vane for a subsequent working cycle of the machine, and during this phase wherein the tray which was closed during the previous cycle, which was separated from the film by the punch, which was previously raised by the lifting means and which was supported by the downstream portion of the main conveyor is retained in the punching station by a fixed vane so as to be able to evacuated during the subsequent working cycle.

23. The machine according to claim 22, further comprising means so that, during a return stroke of the carriage, motors driving the film are all or partly activated with a travel movement which is a reverse of an active working movement, so as to move the film backwards by an appropriate amount and so as to move adequately towards the first deviating means, an opening created in the film by a preceding operation involving punching a lid on a previously closed tray.

24. The machine of claim 23, further comprising optoelectronic sensors for reading indicia on the film.

25. A machine for packaging food products in trays sealingly closed at the top with thermoplastic film, said machine comprising:

a reel and film feeding means for controlled unwinding therefrom of film for closing the trays;

deviating means situated below the reel and around which the film is deviated for changing the film from a descending path to a horizontal path;

counter-die means for supporting at least one tray horizontally, along an upper edge, with a predefined orientation and for displacing it horizontally underneath a horizontal section of film;

welding means situated downstream of the deviating means for welding the film sealingly onto an upper edge of the tray;

means situated upstream of the deviating means for blowing an appropriate quantity of modified atmosphere at appropriate pressure values into an open part of the tray which advances underneath the film until the tray has been completely sealed by the film;

separating means for separating from the film, a portion of the film welded to the upper edge of each tray;

collecting means for taking up the waste film produced by the separation means, the collecting means operating in conjunction with the film feeding means, wherein at least a section of film on a horizontal path advances continuously stretched both longitudinally and transversely;

positioning means which at a start of a cycle supply and position correctly the trays to be closed in the counter-die means;

lifting means which at an end of the cycle raise the closed trays;

tray conveying means for conveying away the closed trays; and horizontal moving means for horizontally moving the counter-die means, which at the end of a cycle is adapted to bring the counter-die means back into a starting position for repetition of a new working cycle;

wherein the horizontal path of the film between the deviating means is superimposed on a horizontal travel path of the trays feeding a main conveyor with belts over deviating rollers, a last one of the deviating rollers being connected to a drive unit controlled by a processor, an upper portion of the main conveyor having an intermediate depression with a length suitably greater than that of a largest tray to be processed, the intermediate depression being defined by belts of an upper portion of the conveyor being deviated so as to form a U-shaped path, over U-shaped path rollers which are rotatably supported by a carriage by which, by suitable means are adapted to be displaced horizontally and moved from a tray loading position into a position for unloading the tray and vice versa; and a flat and horizontal counter-die arranged in the intermediate depression, the counter-die being fixed to a carriage and with an upper side thereof being coplanar with an upper portion of the belts of the conveyor so that a tray is able to pass without obstacles from an initial section of the belts to the counter-die which is provided with an opening having a form and dimensions correlated to a body of the tray which is able to fit into the opening and may remain resting with its upper edge on a portion of the counter-die which circumscribes the opening, the carriage comprising a pair of side-walls which support the counter-die in a manner such that it may be easily and rapidly interchanged with other counter-dies upon a variation in the shape or size of the trays to be closed, and the side-walls are fixed together by special cross-members which comprise a bottom cross-member having, fixed thereto, a pair of vertical guides inside which corresponding rods slide, the rods being fixed at their top end to a cross-piece having, mounted thereon, a raising plate which, by means of a pneumatic cylinder and piston unit or other rectilinear actuator fixed with its body to the cross-member and connected with its stem to the cross-piece, actuatable to be raised inside the opening, in a manner coplanar with the die, or may be lowered.

26. The machine according to claim 25, in which an initial section of the upper portion of the main conveyor travels over a flat structure fixed to a frame of the machine and has a length sufficient to support at least one tray, and a final section of the upper portion of the main conveyor is free from obstacles underneath.

27. The machine according to claim 25, wherein the side-walls of the carriage are fixed to a middle part of a pair of horizontal rods which, at one end, are fixed to a slide and which, at the other end, support rollers with bearings sliding on a rail fixed to a frame of the machine, the slide being slidable on a pair of horizontal rods fixed at their ends to the frame which is in turn fixed to a side-wall of the base of the machine and on which a screw is rotatably mounted, parallel to the rods, the screw co-operating with a female thread housed inside the slide and able to be rotated in both directions and at an appropriate speed by a drive unit which is also fixed to the frame and provided with an electric motor for electronic speed and phase control, and sensors for detecting at least a rest position of the carriage and the high position of the lifting device.

28. The machine according to claim 27, further comprising a fixed sensor which produces a presence and consent signal for activation of a punching head, when the carriage with the counter-die reaches the end of the active working stroke.

29. The machine according to claim 27, further comprising a nozzle device immediately upstream of the deviating means, the nozzle device blowing the modified atmosphere into the tray which passes underneath it, so as to expel from the tray, the air using the modified atmosphere, the nozzle device having a curved form with a concavity directed towards the first deviating means, the nozzle device terminating at a short distance from an upper mouth of the trays which pass underneath the nozzle device.

30. The machine according to claim 29, in which the nozzles have an identical width and are spaced from each other by an amount substantially equal to the width, while the space occupied in plan view by the pair of the nozzles is suitably less than the internal width of the tray and the pair of nozzles is symmetrically arranged in the plan view projection of the tray, whereby the two flows of modified atmosphere supplied by the nozzles, after filling the internal and gradually increasing volume of the tray which advances and is gradually covered by the film, may flow back through the empty side spaces and through the empty middle space, preventing any entry of ambient air into the tray.

31. The machine according to claim 29, wherein the nozzle device is composed of a horizontal and hollow bar which is parallel to the deviating means and which at one end is fixed to support means and is connected to the means supplying the modified atmosphere under pressure and which at the other end supports and supplies with equal flows at least one pair of nozzles which are arranged alongside each other and oriented downwards with an appropriate inclination or with a concave curvature towards the deviating means so as to be at a suitable angle with respect to the horizontal surface and terminate with a respective discharge mouth at a short distance from the top of the trays which pass underneath them.

32. The machine according to claim 31, wherein the angle is between 10° and 50°.

33. A machine for packaging food products in trays sealingly closed at the top with thermoplastic film, said machine comprising:

a reel and film feeding means for controlled unwinding therefrom of film for closing the trays;

deviating means situated below the reel and around which the film is deviated for changing the film from a descending path to a horizontal path;

counter-die means for supporting at least one tray horizontally, along an upper edge, with a predefined orientation and for displacing it horizontally underneath a horizontal section of film;

welding means situated downstream of the deviating means for welding the film sealingly onto an upper edge of the tray;

means situated upstream of the deviating means for blowing an appropriate quantity of modified atmosphere at appropriate pressure values into an open part of the tray which advances underneath the film until the tray has been completely sealed by the film;

separating means for separating from the film, a portion of the film welded to the upper edge of each tray;

collecting means for taking up the waste film produced by the separation means, the collecting means operating in conjunction with the film feeding means, wherein at least a section of film on a horizontal path advances continuously stretched both longitudinally and transversely;

means which at a start of a cycle supply and position correctly In the counter-die means the trays to be closed;

lifting means which at an end of the cycle raise the closed trays;

means for conveying away the closed trays;

means for horizontally moving the counter-die means, which at the end of a cycle is adapted to bring the counter-die means back into a starting position for repetition of a new working cycle; and a nozzle device immediately upstream of the deviating means and the film which passes over them, the nozzle device adapted for blowing the modified atmosphere into the tray which passes underneath it, so as to expel from the tray, the air with the modified atmosphere, the nozzle device having a curved form with a concavity directed towards the deviating means, the nozzle device terminating at a short distance from an upper mouth of the trays which pass underneath it and being provided on a front side facing an initial section of a main conveyor with reliefs which form a barrier against which a tray cyclically stops and which in this condition with its body is correctly centred with the opening of the underlying counter-die stationary in the start-of-cycle position, wherein the nozzle device composed of a horizontal and hollow bar which is parallel to the first deviating means and which at one end is fixed to support means and is connected to the means supplying the modified atmosphere under pressure and which at the other end supports and supplies with equal flows to at least one pair of nozzles which are arranged alongside each other and oriented downwards with an appropriate inclination or with a concave curvature towards the deviating means so as to be at an angle of between 10° and 50° with respect to the horizontal surface and terminate with respective discharge mouths at a short distance from the top of the trays which pass underneath them.

* * * * *